United States Patent [19]

Taylor

[11] 4,004,835

[45] Jan. 25, 1977

[54] OVERSHOT

[76] Inventor: William T. Taylor, 222 Camp Lilly Road, Humble, Tex. 77338

[22] Filed: Sept. 15, 1975

[21] Appl. No.: 613,365

[52] U.S. Cl. ..... 294/86.29; 294/86.3; 294/86.33

[51] Int. Cl.[2] ..... E21B 31/12

[58] Field of Search .... 294/86 A, 86.1, 86.17–86.2, 294/86.24–86.33, 90, 116; 24/249 WL, 249 DP, 263 DF; 166/98, 99

[56] References Cited

UNITED STATES PATENTS

| | | | |
|---|---|---|---|
| 1,081,427 | 12/1913 | Brummett et al. | 294/86.31 X |
| 1,365,086 | 1/1921 | Bullum | 294/86.31 X |
| 1,517,426 | 12/1924 | Hickman | 294/86.18 |
| 1,719,144 | 7/1929 | Stokes et al. | 294/86.2 |
| 2,266,873 | 12/1941 | Lang | 294/86.18 |
| 2,296,397 | 9/1942 | Muhlback | 294/86.18 |

*Primary Examiner*—Johnny D. Cherry

[57] ABSTRACT

An improved overshot for grappling a fishing neck is disclosed. A fishing neck has an undercut shoulder with a protruding enlarging thereabove. This disclosure is directed to an overshot having an upper body and a fixed inner tubular sleeve. The tubular sleeve has elongate supports which extend to a bottom ring. The bottom ring has an internal taper. The internal taper works against the right and left halves of a scissor mechanism. The tips of the scissors are constructed with undercuts to reach below and grab the nether shoulder of a fishing neck. The scissors are normally forced closed by the inner taper of the ring. When a fishing neck is engaged, the scissors are forced upwardly, moving as a unit with the scissors mounted on a pin which pin is supported by an outer sleeve which maintains alignment of the moving apparatus relative to the inner sleeve. The pin extends through slots formed in the inner sleeve. As the scissors are forced upwardly relative to the ring, they can open wider and finally reach under the fishing neck. A spring bearing on the top end of the scissors tends to force them down into closing movement against the inner taper of the bottom ring. Through this technique, a fishing neck can be engaged and disengaged by reciprocating upwardly and downwardly relative to the fishing neck.

8 Claims, 3 Drawing Figures

OVERSHOT

BACKGROUND OF THE INVENTION

Various and sundry types of downhole fishing tools including overshots have been devised. Many of the devices known in the past have met with some commercial success. However, it is felt that they are lacking in that they do not provide an apparatus which is capable to grab and lift a fishing neck selectively with a quick release feature. Most downhole tools are equipped with a fishing neck for easy installation and retrieval The present invention is uniquely able to work with a fishing neck equipped item so that it can be either placed in the well or retrieved from the well. The present invention is operated by upward and downward reciprocal motion. This enables its use on a wireline where it is impossible to transmit rotational torque. If needed, this invention can be run on a tubing string but it finds its greatest application in the servicing of wells where a wireline is used. Wirelines are easier to use in servicing well because they require only a power source, wench and wireline. Tubing operated equipment normally requires a derrick and some type of rotary mechanism. It is much slower and much more expensive to use tubing operated tools.

The present invention thus finds an advantage over competitive tools. It is able to grasp and lift a fishing neck. If the fishing neck which is being lifted is first grasped and raised but resistance is encountered, the tool of this invention permits downward movement which releases the fishing neck. This avoids placing undue strain on the overshot, the cable and other equipment.

The overshot of this disclosure is a tool which is relatively simple to use. On a downward motion, the overshot is engaged with a fishing neck. After the fishing neck has been seized, a subsequent and similar downward motion reciprocates the scissor like grasping mechanism up above the fishing neck to release the grasp of the overshot. This is particularly advantageous.

SUMMARY OF THE INVENTION

This disclosure is directed to a wireline operable overshot. It includes an upper body which is attached to an inner sleeve. The inner sleeve surrounds a coil spring. The inner sleeve supports a bottom ring which has an internal axial opening for receiving a fishing neck. The bottom ring has an internally tapered side which engages the bottom end of a pair of scissors. The scissors are forced open and shut on their engagement with the bottom ring. The scissors include undercut tips which engage the shoulder of the fishing neck. The scissors themselves are supported on a transverse pin received in an outer sleeve. The outer sleeve is telescoped around the inner sleeve while the pin passes through slots in the inner sleeve to enable telescoping movement. The scissors are forced downwardly by the spring. When a fishing neck is encountered, the spring force is overcome, the scissors forced upwardly to flare outwardly against the tapered surface of the bottom ring, and pass over the fishing neck to latch the shoulders beneath the neck. Release is achieved by pushing down on the tool.

DESCRIPTION OF THE PREFERRED EMBODIMENT

Figure 1:
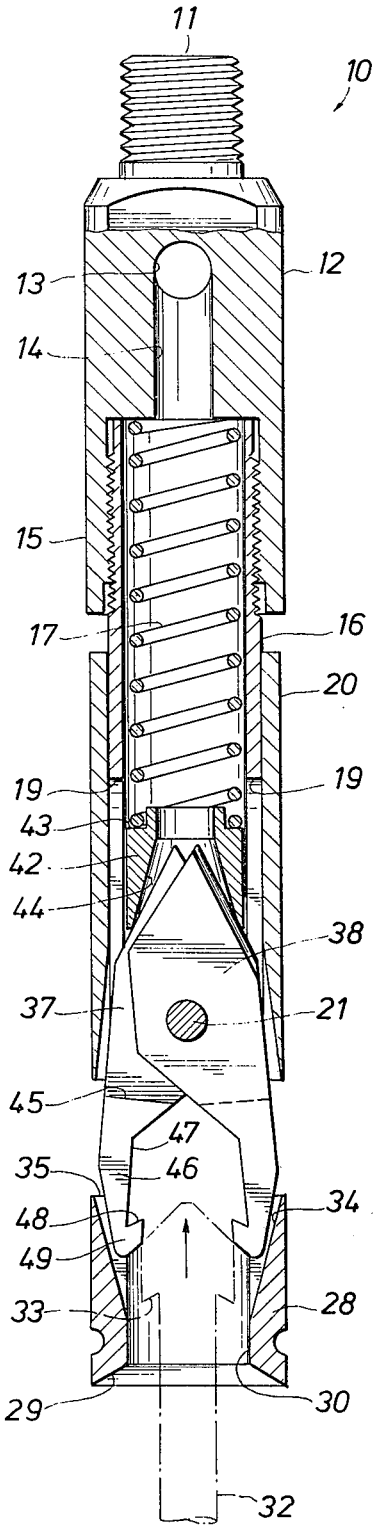
FIG. 1 is a sectional view of the overshot of the present invention illustrating a scissor operated grasping mechanism prior to latching over a fishing neck.

In FIG. 1, the overshot of the present invention is identified by the numeral 10. A threaded portion 11 is located at the top end to enable it to be connected with a rope socket or some other apparatus adapted to be easily run in a well. It is normally run on a wireline although tubing can be used. Wireline operation is preferable because it is more easily deployed in the well. The threaded portion 11 connects to a solid upper body 12. An opening 13 permits entry of a wash fluid into an axial passage 14. This enables the tool to be washed during its use. This is helpful in the event that the overshot is run in a sanded well. The solid body 12 terminates in a skirt 15. The skirt 15 is internally threaded to receive the upper end of an inner sleeve 16.

Figure 3:
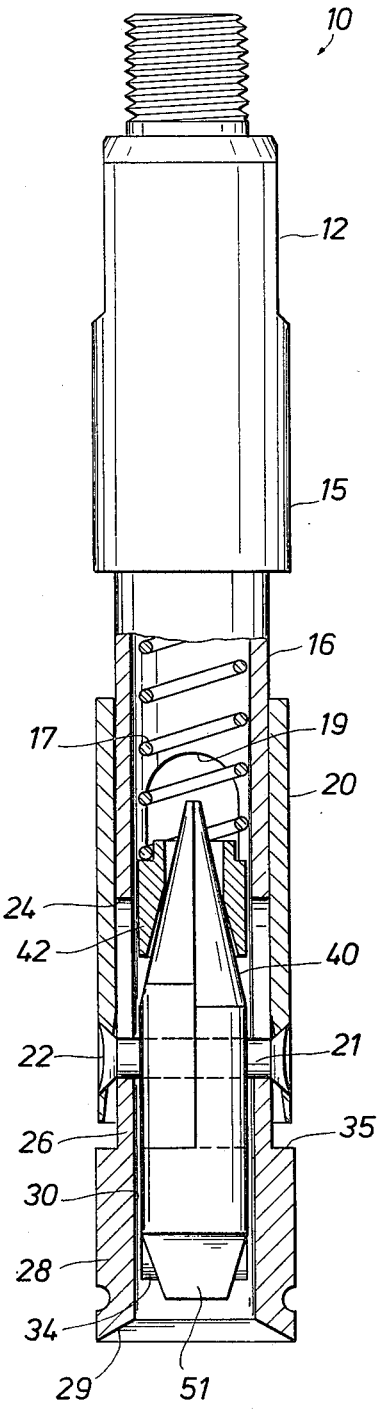
FIG. 3 is a sectional view of the tool in the same relative position of FIG. 2, a sectional view being taken at right angles to the view of FIG. 2 showing additional details of construction including a pin supporting a scissor operated mechanism in the present invention.

The inner sleeve 16 is relatively long. It is also hollow to enable it to receive a compressable coil spring 17. The coil spring is captured by an abutting shoulder in the body 12. The inner sleeve is of cylindrical construction. It is a solid sleeve along its length until a window or slot 19 is encountered. There are two sets of slots, two each, formed in the lower portions of the sleeve 16. The first set is the window or slot 19. Two such parallel slots are located on opposite sides as shown in FIGS. 1 and 3. In fact, it may be said that the slot 19 removes a substantial portion of the inner sleeve at the lower end as will be described. The other set of parallel slots will be described subsequently.

The numeral 20 identifies an outer sleeve which is telescoped over the inner sleeve. The outer sleeve is arranged for sliding movement upwardly and downwardly. The outer sleeve is not connected to the inner sleeve at all but it is free to telescope on it. The outer sleeve is drilled at two locations to receive the upset heads 22 of a pin indicated at 21. The heads are indentified by the numeral 22 in FIG. 3. The heads are counter sunk to define a smooth external surface for the sleeve 20. The pin 21 extends transversely through the inner sleeve. It is received through a second set of elongate slots 24. The slots 24 are arranged diametrically opposite one another. The slots 24 have a width slightly greater than the diameter of the pin to receive the pin for easy upward and downward reciprocating motion. The pin 21 is able to reciprocate upwardly and downwardly in the slot 24. It is shown at the lower limits of its travel in FIGS. 2 and 3. It is relatively raised in FIG. 1 although the slot is not seen because FIGS. 1 and 3 are sectional views at different angles through the tool 10.

The pin 21 is shown in FIG. 3 at the bottom-most extent of travel. It will be recalled that the slots 19 extend parallel to the slots 24 but they are longer. In effect, the inner sleeve terminates in a pair of opposing connective webbing members 26 between the slots 19 which are located near the bottom of the outer sleeve 20. The webbing members are more sufficient to structurally support a bottom ring 28. The ring 28 fully encircles. It has a lower chamferred face 29 which funnels a fishing neck into an axial passage 30. The fishing neck is constructed in accordance with industry standards, those promolgated by the API. The ring 28 passes over the enlargement of the fishing neck. One such fishing neck is indicated by the numeral 32. It will be observed that it has an undercut shoulder 33. The shoulder 33 and the enlargement above it enter the passage 30 and are fully enclosed by the ring 28.

Figure 2:
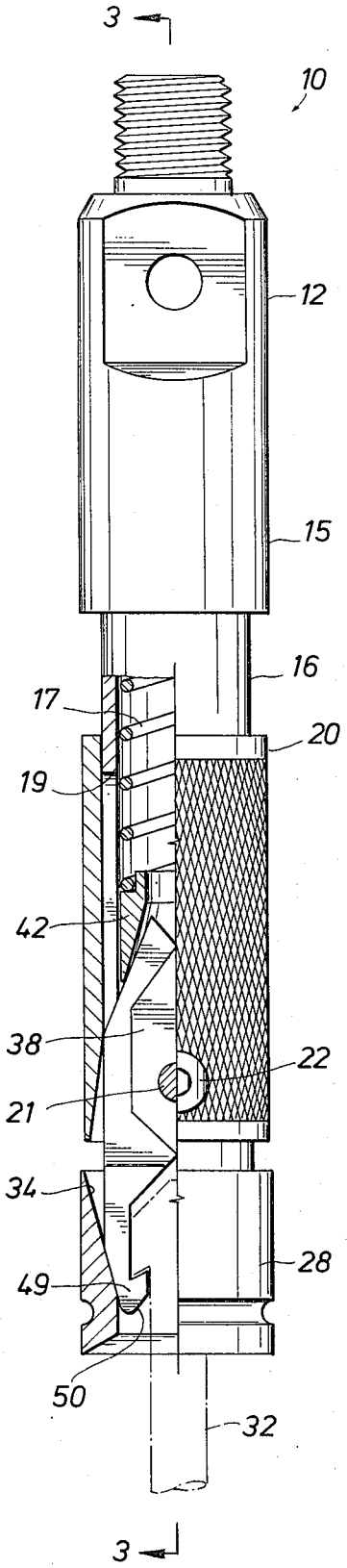
FIG. 2 is a view similar to FIG. 1 showing the scissor operated mechanism latched around the overshot and moved downwardly within the ring of the tool in response to the urging of the compressed spring in the overshot.

The ring 28 is shown in FIG. 3 where the passage 30 is axial and parallel to the outer wall of the ring. That is to say, the wall thickness is uniform at that portion of the ring. However, FIGS. 1 and 2 show opposing tapered faces 34 which intersect the axial passage 30. The faces 34 extend to the upper edge of the ring which is indicated by the numeral 35. The ring 28 is thus provided with tapered shoulders which become wider and wider near the top edge of the ring. These serve as guides for a pair of scissors to be described.

The pin 21 supports a scissor-like mechanism. It has first and second movable members 37 and 38. They are positioned adjacent to one another and supported on the pin 21. As shown in FIG. 3, they have opposing flat faces which are parallel to one another in a position relatively close to one another. The scissor portions 37 and 38 are generally rectangular in cross section near the pin 21. However, their upper end is contoured in a conic external surface as indicated at 40 is FIG. 3. The conic surface is common to both portions of the scissors. The conic surface tapers to a relatively narrow point as shown in FIG. 3 to enable it to be received in a thrust ring 42. The ring 42 has an upper shoulder 43 shown in FIG. 1 which receives the thrust of the coil spring 17. The thrust ring itself is actually hollow and is provided with a tapered internal passage 44. The passage 44 is shown about two halves of the scissor-like mechanism in FIG. 1. FIGS. 1 and 3 in particular should be contrasted. The scissors are open in FIG. 1 to engage in the fishing neck. When they are opened, the two portions are pivoted to an angle with respect to one another and they consequently force the thrust ring 42 upwardly. In FIG. 3 the scissor mechanism is closed. This enables the thrust ring 42 to ride the external conic surface 40 of the scissor-like mechanism downwardly at the urging of the coil spring 17. This downward movement of the thrust ring on the scissor-like mechanism occurs when nothing is engaged by the scissor-like mechanism and its closure is permitted.

The members 37 and 38 extend downwardly from the rod 21. Consider the left hand side of the apparatus shown in FIG. 1. A shoulder 45 defines a relatively thin portion above a thicker portion 46 therebelow. The symetrical scissor portion extends downwardly with an inner face 47. The inner face 47 terminates at an upwardly facing shoulder 48. Preferably, the angle of the shoulder 48 is such that it engages the undercut shoulder 33 of a fishing neck. A hook portion 49 is defined at the very lower end below the shoulder 48. The hook portion has a tapered lower face 50 identified in FIG. 2. The tapered face 50 is on the exterior and intersects at a tight radius of curvature external face 51. The curved face 51 is adapted to be contacted against and guided by the internal tapered face 34 of the ring 28. The tapered faces 50 and 51 thus guide the opposing movable portions of the scissor-like mechanism to engage and grasp a fishing neck. The face 51 is a portion of a conic surface. This enables it to smoothly slide in the internal axial passage 30, modified by the tapered faces 34, of the ring 28 as the ring reciprocates upwardly and downwardly relative to the scissor-like mechanism.

The scissor-like mechanism thus is forced to a closed position in FIG. 3 when it is down within the ring 28. When the ring 28 moves relatively downward (contrast FIG. 1 with FIG. 3) the scissor-like mechanism is free to expand or open. It does not open of its own initiative but rather it responds to a downward thrust of the overshot 10 against the fishing necks 32. When this occurs, the head on the fishing neck is jammed against the hooks 49. The scissor-like mechanism is of course duplicated with right and left hooks. The hooks are forced apart. They ride over the top end of the overshot, and permit the enlargement of the overshot to enter into the hooks, moving towards the pin 21. As the enlargement enters the scissor-like mechanism, there is sufficient room to receive the enlargement. The dimensions of the scissor-like mechanism are calculated to receive the entire enlargement as better shown in FIG. 2 as the scissors move up, open, then close and move downwardly in that sequence. This sequence enables the scissors to close over the enlargement and hold the fishing neck.

Release of the fishing neck is permitted. The neck is shown fully caught in FIG. 2. Assume that an upward pull on the wireline shows that the fishing neck is stuck. The overshot 10 is released by first jarring down on the overshot 10 to force the scissors upwardly as exemplified in FIG. 1. When the scissors move up, they are no longer restrained against opening and will spread open to enable the hook 49 to spread apart from the undercut fishing neck. Opening of the scissors is aided by the force of the spring 17 on the ring 42. The ring acts against the conic surfaces 40 to force the scissors open as can be better understood on viewing FIG. 1. The opening of the scissors frees the fishing neck of the hold of the hooks 49. An upward pull on the wireline lifts the tool away from the fishing neck. The differences in operation of the tool 10 results from the weight of the tool acting on the tool dependent on whether the tool is being raised or lowered. When lowered to engage, the fishing neck forces into the scissors and is caught by the hooks 49. When the tool 10 is raised after first being lowered, the scissors are open and the tool is easily retrieved.

The tool 10 is adjusted by using springs of different spring force. The change of springs 10 varies the weight needed to force open the scissors.

When the overshot 10 is picked up (as in FIG. 2), the hooks 49 lift the fishing neck 32 with a non-slip grip. The grip is held indenfinitely. The load on the scissors is transferred to the pin 21 and then to the inner sleeve 16 and upper body 12.

The foregoing is directed to the preferred embodiment but the scope thereof is determined by the claims which follow.

I claim:

1. An overshot comprising:

a scissor-like mechanism having a pair of facing hook means which open and close toward one another to pick up a fishing neck;

a transverse pin supporting said scissor-like mechanism;

an encircling ring about the lower end of said scissor-like mechanism which, on relative movement upwardly and downwardly, limits the span of opening of said hook means;

a support member connected to said pin for supporting said pin;

first means for relatively moving said ring controllably toward said scissor-like mechanism by moving either said ring or said support member, said first means causing said ring and said hook means to co-act to open and close, said first means further lowering said hook means to close by co-action with said ring when a fishing neck is engaged and the weight thereof acts downwardly thereon;

an upper body supporting said ring and said support member; and said first means comprising a pair of protruding and relatively movable arms pivotally mounted on said pin and comprising a portion of said scissor-like mechanism which, on movement, open or close said scissor-like mechanism;

a resilient means in said upper body bearing against said scissor-like mechanism to open the span of said scissor-like mechanism when it is not in constraining contact with said ring; and said arms being formed with surfaces which contact and co-act with said resilient means to increase the span of opening of said scissor-like mechanism.

2. The apparatus of claim 1 wherein said scissor-like mechanism is forced closed by contacting said hook means with a tapered surface formed on said ring which, on axial movement, forces said mechanism toward a closed condition.

3. The apparatus of claim 1 wherein said support member is first sleeve telescoped with a second sleeve, said first sleeve being slidably mounted around and on the exterior of said second sleeve, said second sleeve being fixedly supported by said upper body and including a downwardly directed and appended connective means for said ring, said second sleeve having a pair of diametrically opposite slots parallel to one another through which said pin can slide longitudinally in moving said scissor-like mechanism relatively axially thereof.

4. The apparatus of claim 3 wherein said second sleeve is inside said first sleeve and said second sleeve is threadedly joined to said upper body and said pin and first sleeve move as a unit.

5. The apparatus of claim 1 wherein said scissor-like mechanism includes an internal shoulder on said hook means positioned to grab and engage the nether part of a fishing neck, said internal shoulder facing upwardly.

6. The apparatus of claim 5 including an external sloping surface on said hook means which is inclined inwardly and downwardly, said surface cooperatively working against said ring.

7. The apparatus of claim 1 wherein said resilient means terminates in a ring like lower appendage contacted against said scissor-like mechanism.

8. The apparatus of claim 7 wherein said scissor-like mechanism is squeezed toward a closed condition by said ring which is carried relatively vertically on an axially movably sleeve which moves axially compared to said pin and said scissor-like mechanism.

* * * * *